US006156983A

United States Patent [19]

Chen et al.

[11] Patent Number: 6,156,983

[45] Date of Patent: Dec. 5, 2000

[54] WATER-PROOF KEYBOARD

[75] Inventors: Tsung-Min Chen; Heng-Liang Lin, both of Taipei Hsien, Taiwan

[73] Assignee: Chicony Electronics Co., Ltd., Taipei Hsien, Taiwan

[21] Appl. No.: 09/283,219

[22] Filed: Apr. 1, 1999

[51] Int. Cl.[7] ..... H01H 13/70

[52] U.S. Cl. ..... 200/302.1; 200/5 A; 200/302.2

[58] Field of Search ..... 200/5 A, 512, 200/517, 302.1, 302.2, 341, 344, 345; 400/472, 490, 495, 496

[56] References Cited

U.S. PATENT DOCUMENTS 5,117,074 5/1992 Yanai et al. ..... 200/302.3
5,810,491 9/1998 Muller et al. ..... 400/496
5,824,981 10/1998 Suzuki ..... 200/302.1

*Primary Examiner*—Michael Friedhofer
*Attorney, Agent, or Firm*—Rosenberg, Klein & Lee

[57] ABSTRACT

A water-proof keyboard, wherein proper grooves are installed on the upper cover of the keyboard, and a plurality of drain holes are installed on the front edge of each groove. The drain holes are penetrated to the bottom of the upper cover and drain tubes are connected therebelow. A plurality of sleeves with respect to the drain tubes are installed on the seat of the keyboard. Within each sleeve is formed with a respective through hole each drain tube inserts into the respective through hole within the sleeve. In the water-proof keyboard of the present invention, the liquid flowing into the keyboard may drain out rapidly so that the liquid flowing into the circuit unit can be prevented effectively. Therefore, the circuit will not short or destroyed.

1 Claim, 3 Drawing Sheets

WATER-PROOF KEYBOARD

BACKGROUND OF THE INVENTION

1. Field of the Invention

The present invention relates to a water-proof keyboard, and especially to a keyboard structure which can drain liquid entered.

2. Background of the Invention

With the improvement of technology, computers have become a popular commercial product. While keyboard is an important peripheral device for receiving messages. If no keyboards, messages can not be inputted to a computer, and thus computers does not work.

However, a prior art keyboard has bad water-proof property. If liquid flows into the keyboard and contacts with the circuit unit, then the circuit will probably short and be destroyed so that the keyboard can not work well. Such as Taiwan Patent Publication Nos. 194192, 254445, 279523, etc. disclose structures of keyboards.

Another prior art keyboard, such as those disclosed in Taiwan Patent Publication No. 236428, wherein a plurality of drain tubes and correspondent through holes are arranged on the bottom of the upper cover and the lower cover. By the drain tubes, liquid flows to a liquid collector on the bottom of the lower cover for preventing liquid flowing to the circuit unit. However, this design has a complicated structure. The drain tubes and through holes are necessary to be arranged on the whole keyboard panel. Therefore, manufacturing process is complicated. Moreover, when liquid is connected within a keyboard, if the keyboard is turned carelessly, then the liquid stored within the keyboard will flow back to cause a serious destroy.

SUMMARY OF THE INVENTION

Accordingly, the object of the present invention is to provide a water-proof keyboard. Wherein proper grooves are installed on the upper cover of the keyboard, and a plurality of drain holes are installed on the front edge of each groove. The drain holes are penetrated to the bottom of the upper cover and drain tubes are connected therebelow. A plurality of sleeves with respect to the drain tubes are installed on the seat of the keyboard. A through hole is formed within each sleeve, each drain tube inserts into the respective through hole within the sleeve. When liquid flows into the keyboard, liquid will flow into the groove of the upper cover. By the inclination of the keyboard, the liquid will flow towards the drain hole on the front edge of the groove so as to be drain out of the keyboard directly through the through holes of the sleeve. In the water-proof keyboard of the present invention, the liquid flowing into the keyboard may be drain out rapidly so that the liquid flowing into the circuit unit can be prevented effectively. Therefore, the circuit will not be shorted or destroyed. It may be easily produced and manufactured and has the effect of reducing fabrication cost. In the present invention, liquid is drained outsides and is unnecessarily poured out manually. Therefore, the danger from the accident that liquid flows backwards is prevented.

The present invention will be better understood and its numerous objects and advantages will become apparent to those skilled in the art by referencing to the following drawing in which:

DETAILED DESCRIPTION OF THE PREFERRED EMBODIMENT

Figure 1:
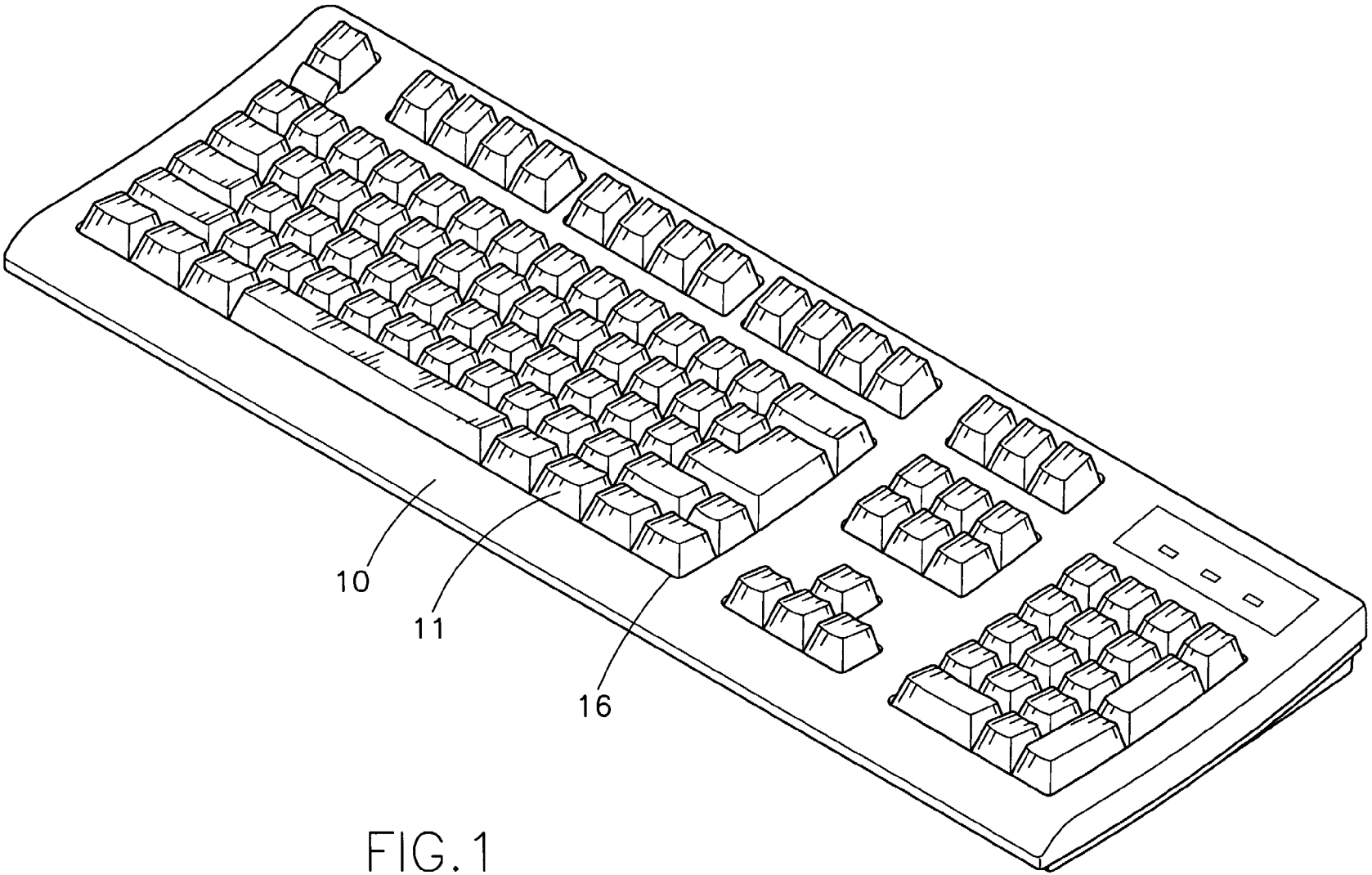
FIG. 1 is a perspective view of the present invention.
Figure 2:
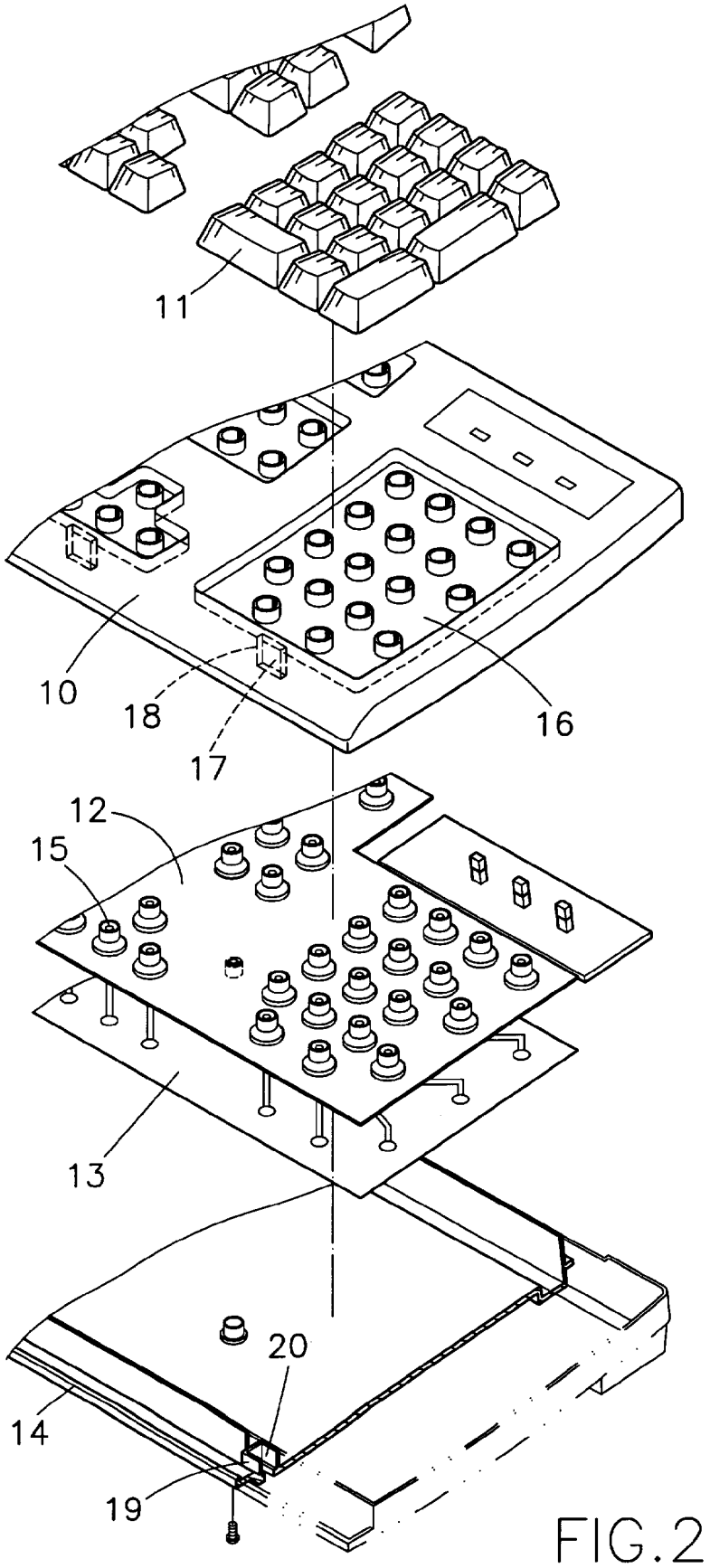
FIG. 2 is an exploded perspective view of the present invention.
Figure 3:
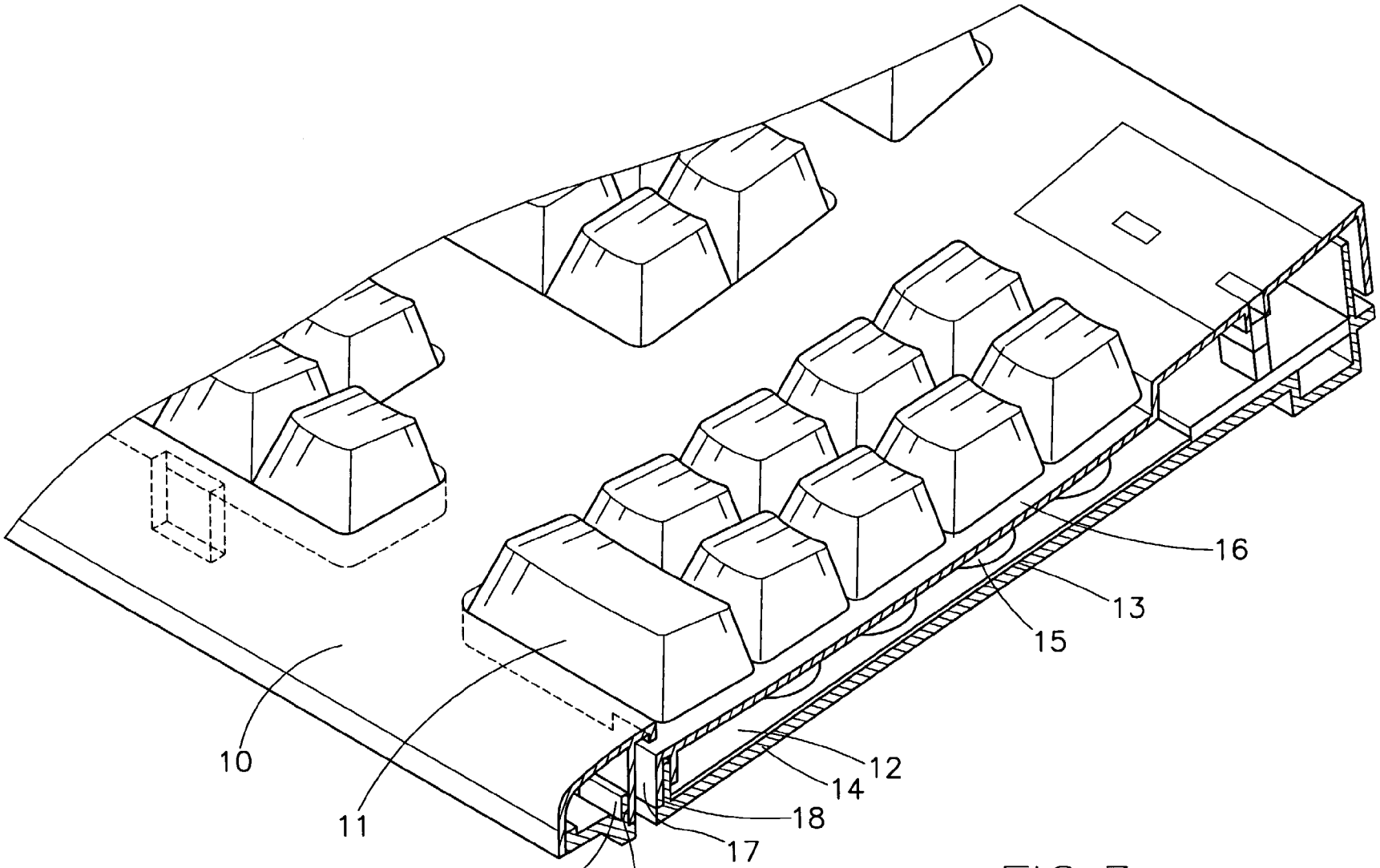
FIG. 3 is a cross sectional perspective view of the present invention.

With reference to FIGS. 1, 2 and 3, a water-proof keyboard of the present invention is illustrated. The keyboard includes an upper cover 10, keys 11, a rubber elastic body 12, a circuit unit 13, a seat 14, etc which are fixed sequentially. The rubber elastic body 12 is formed between the keyboard 11 and the circuit unit 13. The touch controlling hat 15 of the rubber elastic body 12 contacts with the keys 11.

If a key 11 is pressed, then the touch controlling hat 15 of the rubber elastic body 12 is pressed so as to press the circuit unit (thin film circuit) 13 of the touch controlling hat 15 is conducted to form an electric contact. If the key 11 is released, by the elasticity of the touch controlling hat 15, the key 11 will restored to the original position. Since the aforementioned structure of a keyboard is well known in the prior art and not within the scope and spirit of the present invention, the detail thereof will not be described further.

In the present invention, proper grooves 16 are installed on the upper cover 10. A plurality of drain holes 17 are formed on the front edge of the groove 16. Since each drain hole 17 is in the lowest point in the front rim of the groove 16, when liquid flows into the groove 16, the liquid will flow into the drain hole 17 successfully. Each drain hole 17 penetrates to the lower portion of the upper cover 10 and is connected to a hollow drain tube 18. A plurality of hollow sleeves 19 with respect to the hollow drain tube 18 are installed on the seat 14 of the keyboard. A through hole 20 is formed within the sleeve 19. The drain tube 18 inserts into the respective through hole 20 of the respective sleeve 19. By the aforementioned structure, a water-proof keyboard is assembled.

When liquid flows into the keyboard, liquid will flow into the groove 16 of the upper cover 10, and by the inclination of the keyboard, the liquid will flow towards the drain hole 17 on the front edge of the groove 16 so as to drain out the keyboard directly through the through hole 20 of the sleeve 19.

In the water-proof keyboard of the present invention, the liquid flowing into the keyboard may drain out rapidly so that the liquid flowing into the circuit unit 13 can be prevented effectively. Therefore, the circuit will not be shorted or destroyed. The structures of the drain hole 17, drain tube 18, sleeve 19 and through hole 20 of the present invention are very simple and they are only necessary to be installed on the front edge of the groove 16. It may be easily produced and manufactured and has the effect of reducing fabrication cost. In the present invention, liquid is drained outsides and is unnecessarily poured out manually. Therefore, the danger from the accident that liquid flows backwards is prevented.

Although the invention has been described in detail with reference only to a preferred embodiment, those skilled in the art will appreciate that various modifications can be made without departing from the invention. Accordingly, the invention is defined only by the following claims which are intended to embrace all equivalent thereof.

What is claimed is:

1. A liquid damage resistant keyboard assembly comprising:

(a) a seat having formed therein a plurality of through holes, said seat including at least one hollow sleeve portion protruding therefrom disposed about at least one of said through holes;

(b) a circuit unit coupled to said seat;

(c) an elastic body having a plurality of resiliently deflectable controlling hat formations substantially overlaying said circuit unit;

(d) an upper cover substantially enveloping an upper portion of said elastic body for catching and guiding liquid received thereby to drain through at said least one of said through holes of said seat, said upper cover having formed therein at least one recessed groove portion, said at least one recessed groove portion defining a sidewall section for retaining the liquid, said sidewall section having formed therein a laterally recessed hollow drain tube region defining a downwardly extending drain hole in open communication with said at least one of said through holes of said seat, said hollow drain tube region engaging said at least one hollow sleeve of said seat.

* * * * *